US010076147B2

(12) United States Patent
Rich et al.

(10) Patent No.: US 10,076,147 B2
(45) Date of Patent: Sep. 18, 2018

(54) PANT STRAP

(71) Applicants: Jason Rich, Boston, MA (US); Lisa Hitchings, Rochester, NY (US)

(72) Inventors: Jason Rich, Boston, MA (US); Lisa Hitchings, Rochester, NY (US)

( * ) Notice: Subject to any disclaimer, the term of this patent is extended or adjusted under 35 U.S.C. 154(b) by 606 days.

(21) Appl. No.: 14/337,267

(22) Filed: Jul. 22, 2014

(65) Prior Publication Data

US 2016/0021955 A1 Jan. 28, 2016

(51) Int. Cl.
*A41F 17/04* (2006.01)
*A41D 17/00* (2006.01)

(52) U.S. Cl.
CPC ..... *A41F 17/04* (2013.01); *A41D 17/00* (2013.01)

(58) Field of Classification Search
CPC ..... A41F 17/04; A41F 17/00
See application file for complete search history.

(56) References Cited

U.S. PATENT DOCUMENTS 1,346,448 A * 7/1920 Ewing ..... A41D 17/02 36/2 R
1,708,144 A * 4/1929 Martin ..... A41D 17/00 2/61
1,712,035 A * 5/1929 Frykman ..... A43B 3/02 36/1.5
2,480,276 A * 8/1949 Wilkenfeld ..... A41D 1/06 2/232
2,525,756 A * 10/1950 Aines ..... A41D 1/06 2/232
2,757,460 A 8/1956 Bufis
3,083,373 A * 4/1963 Rizzotto ..... A41D 17/00 2/227
3,086,529 A * 4/1963 Munz ..... A61B 17/1322 128/878
3,238,537 A * 3/1966 Fowler ..... A41D 13/06 2/242
3,442,270 A * 5/1969 Steinman ..... A61F 13/00021 128/DIG. 15
3,633,290 A * 1/1972 Rubeling ..... A41D 17/00 36/2 R
3,733,615 A 5/1973 Jaffee
3,879,763 A * 4/1975 Smith ..... A41D 13/08 2/59
4,068,318 A * 1/1978 McMahon ..... A41D 20/00 2/170

(Continued)

FOREIGN PATENT DOCUMENTS

| | | |
|---|---|---|
| CA | 2500086 | 12/2005 |
| CN | 203194614 | 9/2013 |
| WO | 2008101306 | 8/2008 |

OTHER PUBLICATIONS

Boot Straps for Jeans and Pants—Hollywood Fashion Secrets, https://hollywoodfashionsecrets.com/product/boot-straps-for-jeans-and-pants/, visited Mar. 3, 2015.

*Primary Examiner* — Richale Quinn
(74) *Attorney, Agent, or Firm* — Gary E. Lambert; David J. Connaughton, Jr.; Lambert & Associates

(57) ABSTRACT

A pant strap is provided. The pant strap is configured to be wrapped about a user's leg over a pant leg, worn under but not attached to footwear so that it is not visible. The pant strap neatly holds the pant leg in place, minimizing wrinkling of the pant leg and allows the pant to be easily slid into and out of an item of footwear.

6 Claims, 4 Drawing Sheets

(56) References Cited

U.S. PATENT DOCUMENTS

| | | | | | |
|---|---|---|---|---|---|
| 4,527,566 | A * | 7/1985 | Abare | A61F 7/02 | 601/15 |
| 4,825,475 | A * | 5/1989 | Smart | A41F 17/02 | 2/312 |
| 5,010,597 | A * | 4/1991 | Glover | A41D 17/02 | 2/22 |
| 5,170,503 | A * | 12/1992 | Hightower, Jr. | A41D 17/02 | 2/22 |
| 5,173,967 | A * | 12/1992 | Carter | A41D 13/0543 | 2/16 |
| 5,653,244 | A * | 8/1997 | Shaw | A61F 5/0104 | 128/882 |
| 5,913,411 | A | 6/1999 | Spurling | | |
| 6,158,057 | A * | 12/2000 | Neumann | A41F 17/02 | 2/312 |
| 7,937,852 | B1 * | 5/2011 | Krehbiel | A41D 17/005 | 2/22 |
| 8,161,664 | B1 | 4/2012 | Dawson | | |
| 2007/0039207 | A1 * | 2/2007 | Mallamohamad | A43B 3/102 | 36/70 R |
| 2010/0064420 | A1 * | 3/2010 | Coombs | A41F 17/04 | 2/311 |
| 2013/0305570 | A1 | 11/2013 | Blake | | |

* cited by examiner

PANT STRAP

BACKGROUND OF THE INVENTION

Field of the Invention

The present invention relates generally to wrapping devices. More particularly, the present invention relates to a wrapping device for wrapping about a user's pant leg to minimize wrinkling of the pant leg and to facilitate insertion into the/a user's footwear.

Description of Related Art

Often, users of footwear desire to tuck their pants into the footwear. For example, commuters often use this technique to keep their pant legs clean during a/their commute to and from work. This can often be difficult, leading to a messy look, a bunching of the pants, and the pants coming loose from the footwear, resulting in untidy, wrinkled pant legs. All these factors lead to an undesirable experience and appearance not only when wearing pants tucked into a footwear, but also at the user's destination when they remove their commuter footwear and replace it with their workplace footwear apparel.

Traditionally, the only solutions are to wear tight pants, get bigger and more accommodating footwear, or to deal with the inconvenience of a physically uncomfortable commute and the unprofessional appearance caused by wearing wrinkled pants throughout the day. No solution is known to exist that addresses the difficulties with inserting pant legs into footwear, or that keeps the pant legs comfortably, secured in place once in the footwear, as well as neat and unwrinkled after the footwear is removed.

Therefore, what is needed is a device and system that may facilitate the insertion of a pant leg into a footwear, provide a more comfortable and tidy appearance during the commuter experience that once removed leaves the pant legs relatively wrinkle free and neat in appearance.

SUMMARY OF THE INVENTION

The subject matter of this application may involve, in some cases, interrelated products, alternative solutions to a particular problem, and/or a plurality of different uses of a single system or article.

In one aspect, a pant strap system is provided. The pant strap has a body and a connector allowing it to be connected to itself in a loop. The connector has two parts allowing two ends of the strap to be connected. In use, the strap is wrapped around a leg of a user, the first and second connector parts being mated together and holding the strap in place about the leg of the user. A pant leg is positioned between the leg of the user and the strap. The strap, when attached, causes the pant leg to be collected in a neat, compressed position under and adjacent to the strap. Footwear is positioned over the leg of the user, the pant leg, and the strap, with the strap allowing the pant to be easily inserted within the footwear and held in place. The pant strap system is not attached to the footwear and is not visible once the footwear is in position.

In another aspect, a method of easing insertion of a pant leg into a footwear is provided. The method may involve wrapping a pant strap about a leg of a user and over a pant leg. This pant strap comprises a body, and a connector, the connector having a first part on a top of the body, and a second part on a bottom of the body, the first part and second connector part configured to be mated together. The connector parts are then connected with the body wrapped about the leg. This connection step causes the pant leg to be collected in a neat, compressed position under and adjacent to the strap. Once the pant leg is strapped, the method includes the step of applying a footwear to a foot of the user and inserting the pant leg within the footwear by sliding the compressed portion into the footwear, with the footwear moving over the leg, pant leg, and pant strap. The pant strap system is not attached to the footwear and is not visible once the footwear is in position.

DETAILED DESCRIPTION

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a strap that may be wrapped around a pant leg of a user under footwear so it is not visible when worn. Once wrapped and secured in place, a user's pants may be easily tucked into footwear, and may be retained therein. As such, the strap may allow for easier insertion of the pant into the boot, may help hold the pants neatly within the footwear, may provide a more stylish, comfortable commuter experience, and further may minimize wrinkling of the pant leg after removal of the footwear and strap. For example, many individuals who commute to work wear commuter footwear and change into workplace footwear upon arrival at their destination. The pant strap provides a system to keep a neat, stylish appearance during their commute, as well as at their destination, such as a workplace, where the user replaces the commuter footwear with workplace appropriate footwear and the pant legs are no longer compressed.

The pant strap contemplated herein comprises a base defining its length and width. In one embodiment, the base may be offered in different sizes to fit different sized individuals. In another embodiment, the base may be one-size fits all.

The base may be formed out of any material capable of being wrapped about a user's leg. This material may be flexible and/or stretchable. Examples of materials of which the base may be made include, but are not limited to: fabrics, sheet materials, flexible plastics, metals, and the like. In one embodiment, the base material may be elastic, allowing its length and/or width to expand and contract. The body may be formed of any shape and size capable of being wrapped around the leg of a user. In varying embodiments, however, the strap may be a long rectangular shape, may have a slightly arcing curve, or may have a trapezoidal shape, among others.

A connector is attached to the base to allow the base to wrap about the leg of a user with both ends held in place securely. The connector may be any device or configuration that allows the base to securely wrap about the leg of a user over the user's pant leg. In some embodiments, the connector may be a two-part mechanism to connect two ends of the device together with one part being on each end. Examples of two-part connector may be any device such as snaps, Velcro® (hook and loop connector), hooks, and the like on each end. In other embodiments, the connector may be a tension lock strap that allows one end of the strap to be threaded through the tension lock and tightened down, leaving the other end free.

Figure 1:
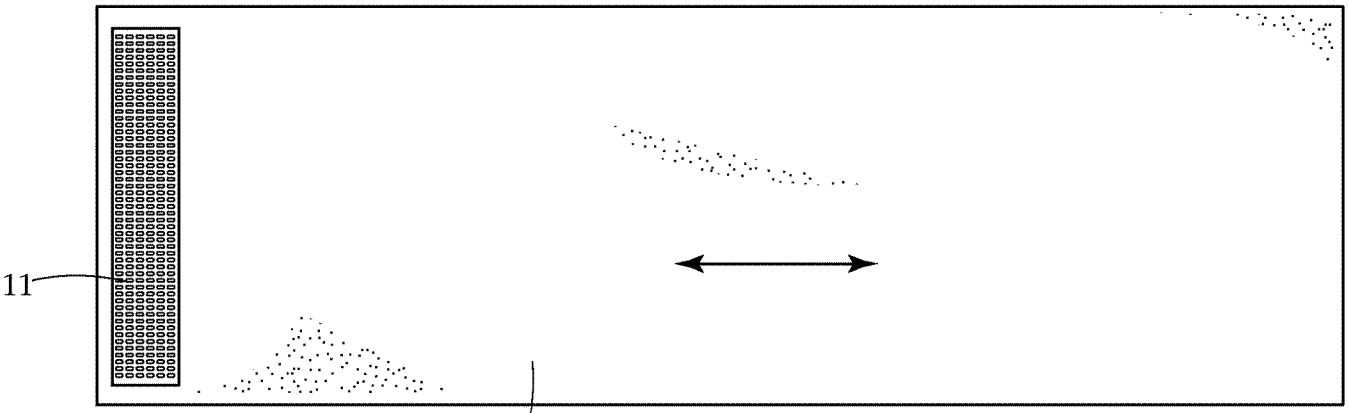
FIG. 1 provides a top elevation view of an embodiment of the pant strap.
Figure 2:
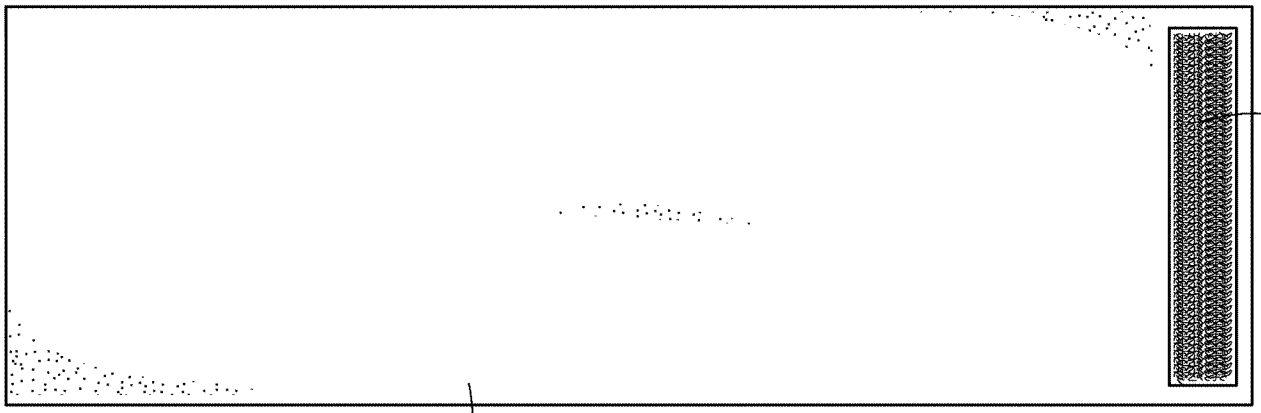
FIG. 2 provides a bottom elevation view of an embodiment of the pant strap.
Figure 3:
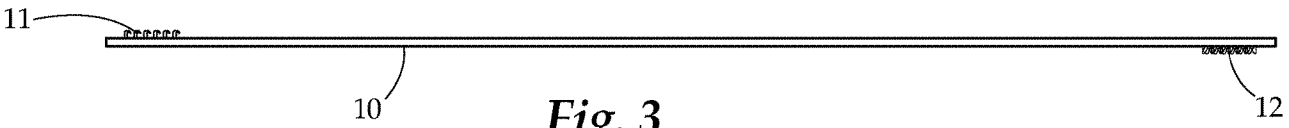
FIG. 3 provides a side view of an embodiment of the pant strap.
Figure 4:
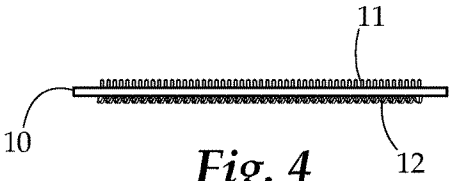
FIG. 4 provides an end view of an embodiment of the pant strap.

Turning now to FIGS. 1 through 4, elevation and side views of an embodiment of the pant strap are provided. FIG. 1 providing a top view of the pant strap, and FIG. 2 providing a bottom view of the pant strap. The strap has a body 10 that is generally rectangular shaped. Body 10 is flexible and able to be wrapped around a leg of a user. A Velcro® (or similar hook and loop) connector is employed in this embodiment. As such, one hook strip 11 piece is attached on a top side of a first end (FIG. 1), and a loop strip 12 piece is attached on a bottom side of the second end (FIG. 2). This embodiment shows the base 10 made of a fabric stretchable in the lengthwise direction, as indicated by the arrow of FIG. 1.

In another embodiment, the body 10 may be formed of a flexible and/or stretchable material having a loop or Velcro® material attached on one side along all or part of the length of the body. In this embodiment, only the one hook strip attachment piece 11 will be needed because it can connect to anywhere in various places on the body 10 side having the loop material, providing the user with both sizing and compression strength flexibility. In a similar but distinct embodiment, the loop strip 12 piece may be large enough to cover a substantial portion of the body, thereby allowing the hook strip attachment piece 11 to connect at various different positions depending on leg size. It should also be understood that the hook and loop connection orientation may be reversed. As such, in alternative embodiments, the hook connection portion may cover a considerable portion of the body, while the loop strip may be small and used to adjust the connection.

Figure 5:
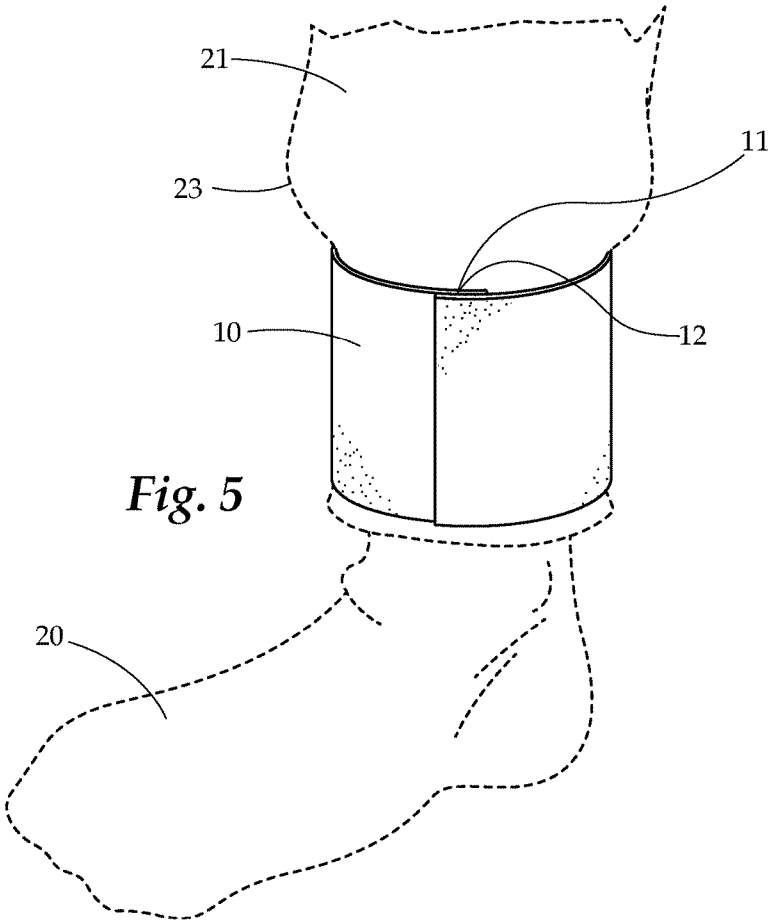
FIG. 5 provides a perspective view of an embodiment of the pant strap in use.

FIG. 5 shows an embodiment of the invention in use. The strap base 10 is wrapped about a leg 20 of a user over the user's pant leg 21. The base 10 ends are connected together by the connector 11, 12. In the area under and adjacent to where the strap is attached, the pant leg 21 is in a narrowed, neatly folded, and compressed position 23. The strap body 10 is wrapped tightly enough around the leg that it is held in place against gravity. As such the user's footwear (not shown) is easily slid over the pant leg 21, especially at the compressed position 23 under the strap base 10. Moreover, during walking there is typically a pulling force on the pant leg 21 urging it to pull out from being tucked into the footwear. The strap, contemplated herein and as shown attached, holds the pant leg 21 in place against this urging.

Figure 6:
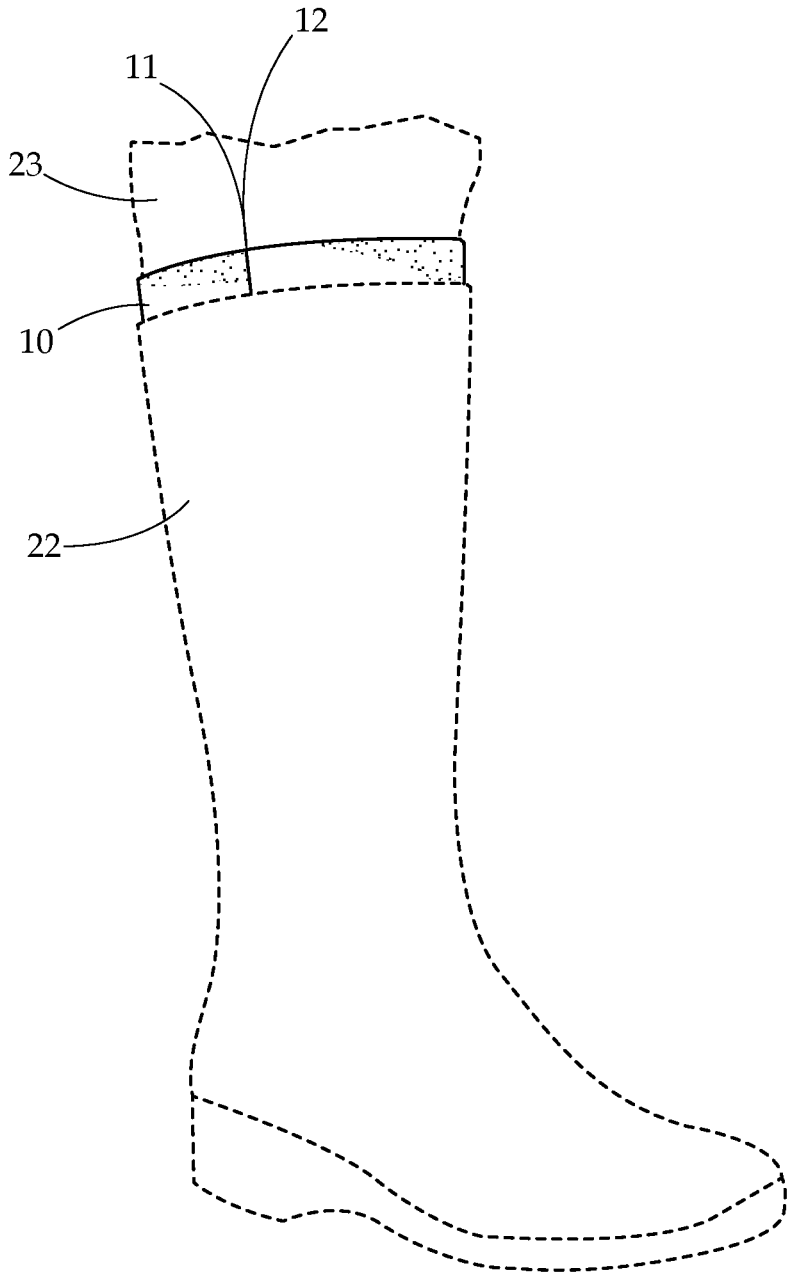
FIG. 6 provides a perspective view of an embodiment of the pant strap in use.

FIG. 6 provides a view of the device aiding in the insertion of a user's leg into the footwear. This view shows the leg partially inserted into the footwear. When fully inserted, the strap body 10 will no longer be visible outside of the footwear 22. The body 10 is wrapped around the pants of a user causing them to be in the neat, compressed position 23. Footwear 22 can then easily fit over the strap body 10 and compressed pants 23. In some embodiments, once the footwear has been properly positioned with the pant leg within, the footwear may then be secured. When the footwear and strap are removed, the pant leg is unfolded and a neat appearance is maintained.

Figure 7:
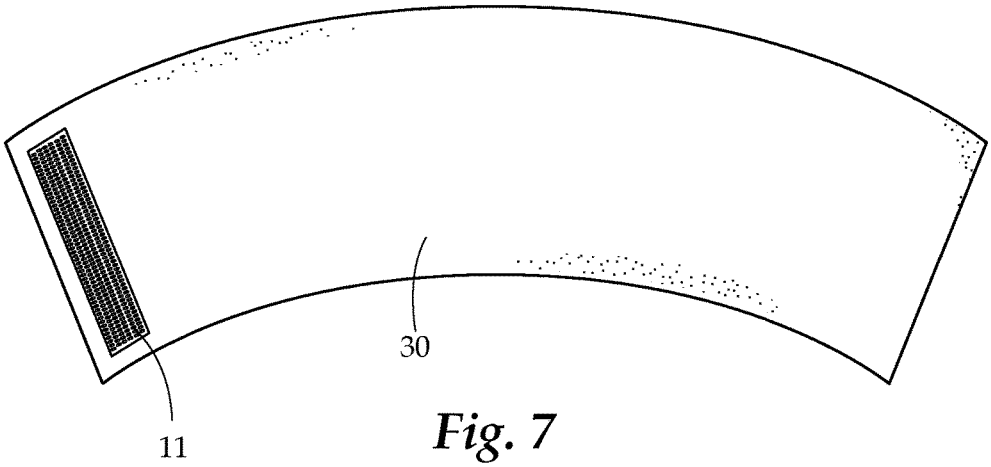
FIG. 7 provides a top elevation view of an embodiment of the pant strap.

FIG. 7 provides another view of an embodiment of the present invention. In this view, base 30 has a slight arcing shape. The arcing shape may allow the strap to be wrapped more comfortably about the leg of a user. Similarly, to FIG. 1, this embodiment has a two-piece hook and loop connector. As such, one hook strip 11 is attached on a top side of a first end, and a loop strip (not shown) is attached on a bottom side of the second end.

Figure 8:
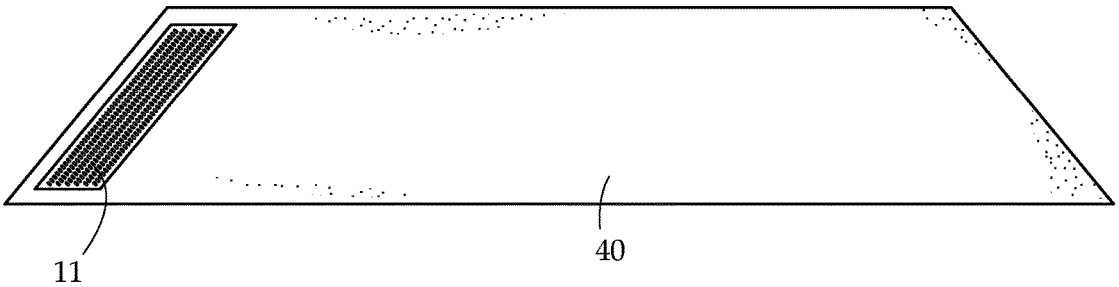
FIG. 8 provides a top elevation view of an embodiment of the pant strap.

FIG. 8 provides another view of an embodiment of the present invention. In this view, base 40 has an approximately trapezoid shape. The trapezoid shape may allow the strap to be wrapped more comfortably about the leg of a user. Similarly, to FIG. 1, this embodiment has a two-piece hook and loop connector. As such, one hook strip 11 is attached on a top side of a first end, and a loop strip (not shown) is attached on a bottom side of the second end.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A footwear assembly comprising:

a footwear, the footwear having a sole, and an upper portion, the upper portion configured to cover a leg of a user above an ankle;

a pant leg positioned within the footwear upper portion, the pant leg in frictional connection with an inner surface of the upper portion;

a strap having a body and a connector, the connector having a first part on a top of the body, and a second part on a bottom of the body, the connector first part and second part configured to be mated together, the strap body having an arced shape when at rest;

wherein the strap is wrapped about the pant leg, the first and second connector parts mated together and holding the strap in place about the pant leg, the pant leg being compressed by the strap under and adjacent to the strap, an entire distal end of the strap positioned between the pant leg and the footwear inner surface of the upper portion and in frictional connection with the footwear inner surface of the upper portion.

2. The footwear assembly of claim 1 wherein a length of the strap defines an arch shape along a length of the strap.

3. The footwear assembly of claim 1 where an entire proximal end of the strap is positioned between the pant leg and the footwear inner surface.

4. The footwear assembly of claim 1 wherein the body is stretchable in a lengthwise direction.

5. The footwear assembly of claim 1 wherein the connector first part and connector second part are a two part hook and loop connector.

6. The footwear assembly of claim 1 wherein the footwear is a boot.

* * * * *